US006508079B2

(12) United States Patent
Wolff

(10) Patent No.: US 6,508,079 B2
(45) Date of Patent: Jan. 21, 2003

(54) MODULAR JEWELRY

(76) Inventor: Natalee Wolff, 51 Magnolia Rd., Briarcliff Manor, NY (US) 10510

( * ) Notice: Subject to any disclaimer, the term of this patent is extended or adjusted under 35 U.S.C. 154(b) by 23 days.

(21) Appl. No.: 09/757,638

(22) Filed: Jan. 11, 2001

(65) Prior Publication Data

US 2002/0088251 A1 Jul. 11, 2002

(51) Int. Cl.[7] ..... A44C 13/00
(52) U.S. Cl. ..... 63/1.16; 63/5.1; 63/40
(58) Field of Search ..... 63/4, 5.1, 38, 40, 63/29.1, 1.11, 1.6, 1.16; 24/701, 113 R, 114.9; 403/381, 375, 360, 356

(56) References Cited

U.S. PATENT DOCUMENTS

| | | | | | |
|---|---|---|---|---|---|
| 1,207,773 | A | * | 12/1916 | Larson | 63/29.1 |
| 2,080,060 | A | * | 5/1937 | Placco | 24/697.1 |
| 2,622,291 | A | * | 12/1952 | Drell et al. | 24/109 |
| 4,653,292 | A | * | 3/1987 | Maupin et al. | 24/104 |
| 4,982,581 | A | | 1/1991 | Furuyama | |
| 5,161,390 | A | * | 11/1992 | Sam | 63/12 |
| 5,367,891 | A | | 11/1994 | Furuyama | |
| 5,369,854 | A | | 12/1994 | Stephens | |
| 5,410,784 | A | * | 5/1995 | Katz | 24/587.1 |
| 5,456,095 | A | * | 10/1995 | Tawil et al. | 24/574.1 |
| 5,499,985 | A | | 3/1996 | Hein et al. | |
| 5,774,957 | A | | 7/1998 | Kohl et al. | |
| 6,058,576 | A | | 5/2000 | Harris | |
| 6,079,224 | A | * | 6/2000 | Schehr | 63/12 |

FOREIGN PATENT DOCUMENTS

| | | | | |
|---|---|---|---|---|
| CH | 669315 A | * | 3/1989 | A44C/5/10 |

* cited by examiner

*Primary Examiner*—J. J. Swann
*Assistant Examiner*—Dinesh N Melwani
(74) *Attorney, Agent, or Firm*—Barnes & Thornburg

(57) ABSTRACT

An ornamental jewelry kit comprising at least one inner flat base element, a plurality of outer visible elements, wherein the plurality of outer visible elements are comprised of visible elements differing from other visible elements by at least one of color, material and shape, cooperating connection means comprising parts on the flat base element and parts on the visible elements for connecting the base and visible elements together, the cooperating means including at least two partially covered tracks and at least two posts with enlarged heads with the posts insertable into the tracks, the partially covered tracks have an uncovered portion allowing an enlarged head of the posts to enter into the covered tracks, the partially covered track is formed with at least a first passageway portion and a second passageway portion angled to the first passageway, and wherein a selected outer visible element is connected to the base element by aligning the at least two posts with respective uncovered portions of the covered tracks with the outer visible element offset from the respective base element, inserting the posts into the tracks, moving the outer visible element relative to the respective base element to cause the posts to move along the first passageway portion and then along the second angled passageway to a position where the outer visible element covers the base element.

23 Claims, 6 Drawing Sheets

MODULAR JEWELRY

BACKGROUND AND SUMMARY OF THE INVENTION

The invention relates to modular jewelry wherein each piece in a stud, necklace, earring, bracelet, pin, anklet tie clasp etc. is formed from two pieces (a base element and an outer visual element) connectable together. Different color patterns of the jewelry can be obtained by replacing a first colored outer element with a second and different colored outer element. These elements could be made from different materials such as white gold and regular gold. Likewise a different visual appearance can be obtained by replacing a circular shaped outer element with an arrow or rectangular shaped outer element, etc. The pieces of the jewelry are formed by connectable elements that can form the whole item ofjewelry on just a clasp for a necklace or anklet wherein at least the base and visual elements of at least one piece of the jewelry are each connected to other pieces by links.

The length of the jewelry chain can be shortened or lengthened by the subtraction or addition of pieces. The pieces of the jewelry can be rigidly connected together by links or flexibly connected together by links with curved surfaces allowing relative pivoting between elements.

A single piece of the jewelry is made from a base element having tracks in its outer facing surface and a visible outer element having headed pins on its backside. The tracks have a first opened keyhole end to accept the head of the pin. Connected to the keyhole end is a covered track having a first segment and an angled second segment. To assemble a single piece of the jewelry the visual element is placed offset on the base element and the head of the pins inserted into the open keyhole end of the track. The visual element is then moved (linerally or rotatively) with respect to the base element to cause the shaft of the headed pin to traverse the first track segment and then the visual element is moved to be superimposed over the base element wherein the shaft of the headed pin traverses the second track segment. A raised protuberance is located in the second track segment. In traversing the second track segment the head of the pin is squeezed by the protuberance wherein the protuberance acts to limit uncoupling of the base and visual element.

Preferably the base element has a flat back surface to allow each piece of the jewelry to lie flat against the skin or clothing of a wearer of the jewelry.

Other objects, advantages and novel features of the present invention will become apparent from the following detailed description of the invention when considered in conjunction with the accompanying drawings

DETAILED DESCRIPTION OF THE DRAWINGS

Figure 1:
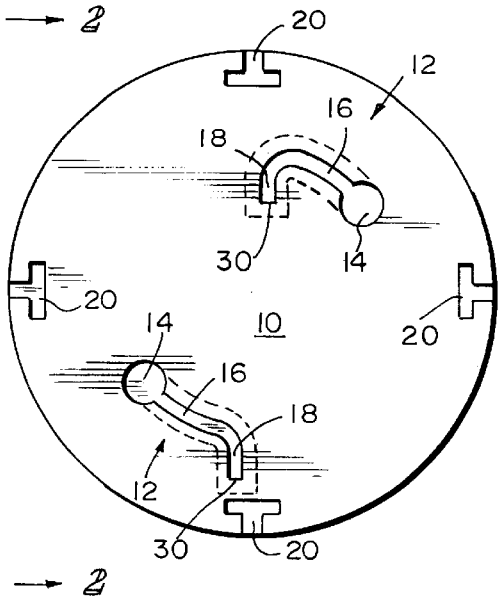
FIG. 1 shows a top plan view of the flat base element of the jewelry indicating two curved connection tracks and four link connecting recesses.
Figure 2:
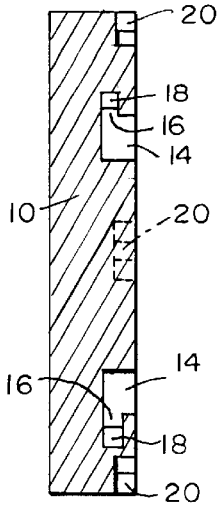
FIG. 2 shows a cross-sectional view of the base element of FIG. 1 taken along line 2—2 of FIG. 1.
Figure 4:
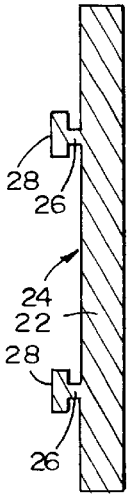
FIG. 4 shows a cross-sectional view of the outer visible element taken along line 4—4 of FIG. 3.
Figure 3:
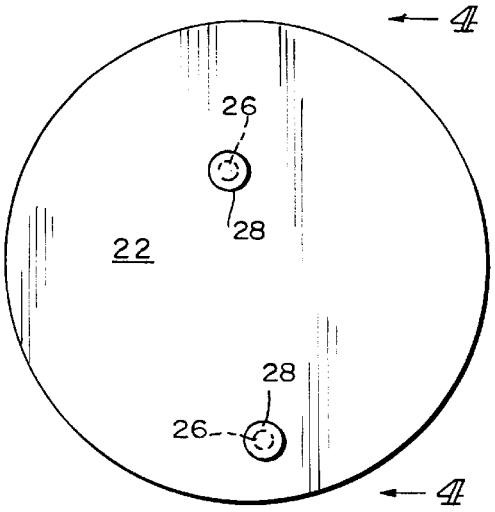
FIG. 3 shows a bottom plan view of an outer visible element showing two headed posts extending upwardly from its bottom surface.

FIG. 1 shows a outer facing surface of a circular base element 10. Cut into the outer facing surface of the base element are two partially covered tracks 12. The tracks 12 have an opened uncovered keyhole portion 14, a first covered track segment 16 and an angled second covered segment 18. Also cut into the outer facing surface of the base element are four connecting link receiving recesses 20. FIG. 3 shows the outer visual element 22. Protruding from the back side 24 of the outer visual element 22 are two pins 26 having a enlarged head portion 28.

Figure 5:
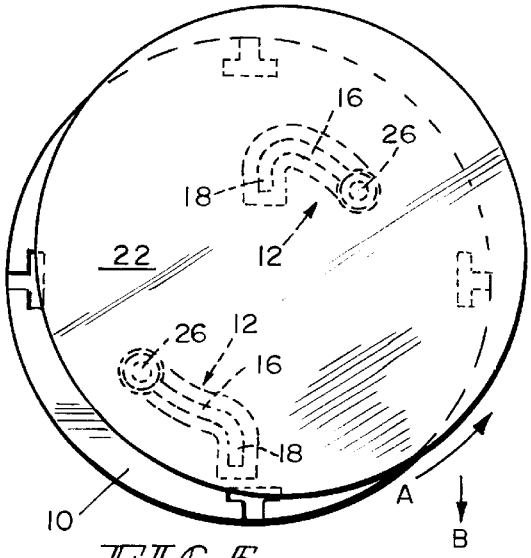
FIG. 5 shows a base element below a visible element with the headed posts inserted into an enlarged end portion of the two curved connection tracks of the base element at the beginning of process connecting the visual element to the base element.

Each piece of the jewelry comprises joining a base element 10 with a visual outer element 22. FIG. 5 shows how the base element 10 and outer visual element 22 are joined together. The outer visual element with the pins 26 facing the top face of base element 10 is offset from the base element 10 whereby the heads 28 of the pins 26 are inserted into the opened keyhole portion 14 of track 12. The outer visual element 22 is then rotated in the direction of arrow A (FIG. 5) to cause the pin 26 to traverse the first covered track segment 16. The outer visual element 22 is then moved linerally along the direction B (FIG. 5) to overlap the base element 10 to cause the pin 26 to traverse the second closed track segment 18 to its end 30 wherein the outer visual element 22 is superimposed atop the base element 10.

Figure 6:
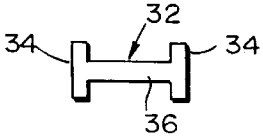
FIG. 6 shows a plan view of the H-shaped connecting link used to connect adjacent base elements.
Figure 7:
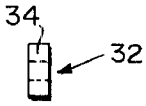
FIG. 7 shows an end view of a H-shaped link of FIG. 6 used to connect adjacent base elements.
Figure 8:
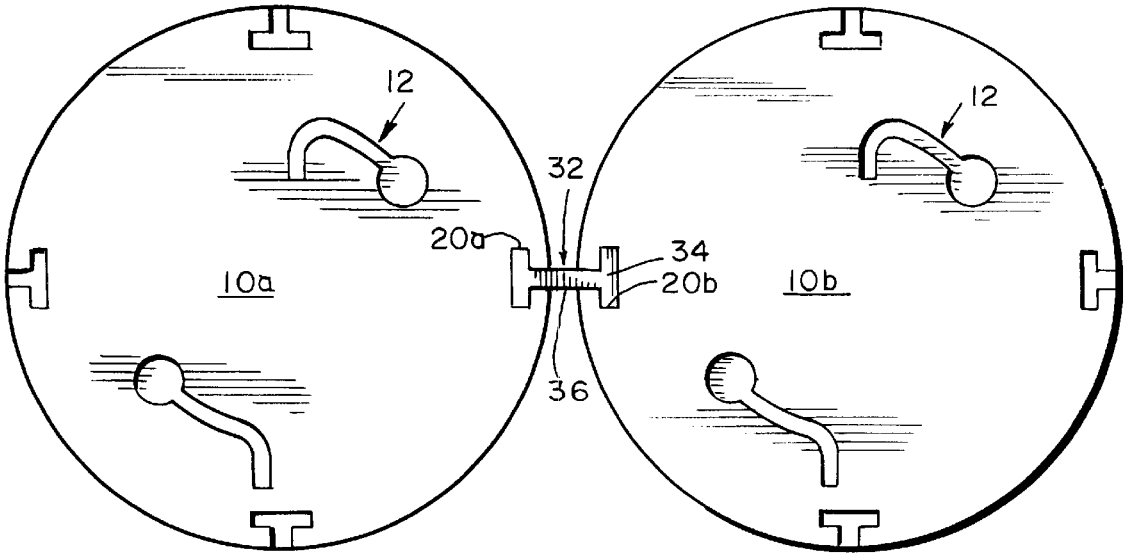
FIG. 8 shows two base elements connected with the link of FIGS. 6 and 7.

FIG. 8 shows how one can connect two adjoining base elements 10*a* and 10*b*. A connecting H-shaped link 32 having ends 34 and cross-bar 36 (FIGS. 6 and 7) has its heads dropped into the link recess 20*a* and 20*b* in the respective two base elements 10*a* and 10*b* as shown in FIG. 8. When the outer visual elements 22*a* and 22*b* are secured to their base elements 10*a* and 10*b* the links are trapped in their respective recesses 20.

While the recesses 20 are shown to be in the base element, they could be located on the outer visual elements 22. Likewise, the pins 26 could be located on the base element 10 with the partially covered tracks 12 on the backside of the visual elements 22.

Figure 9:
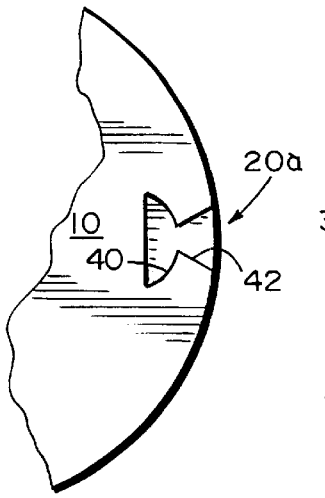
FIG. 9 shows a first modification of base element connecting recesses.
Figure 10:
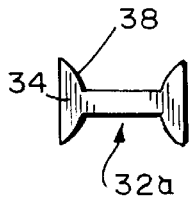
FIG. 10 shows an plan view of the H-shaped link used with recess of FIG. 9.
Figure 11:
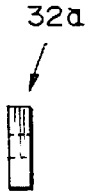
FIG. 11 shows an end view of the link of FIG. 10.
Figure 12:
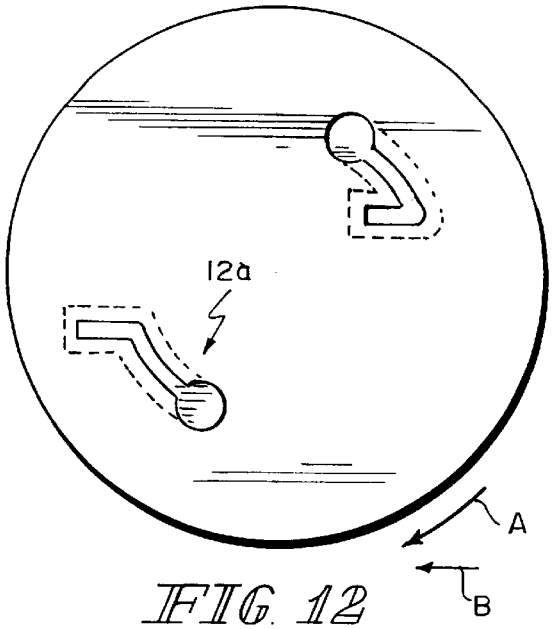
FIGS. 12–15 show alternative connecting track configurations for attaching a base element to a visible element.
Figure 13:
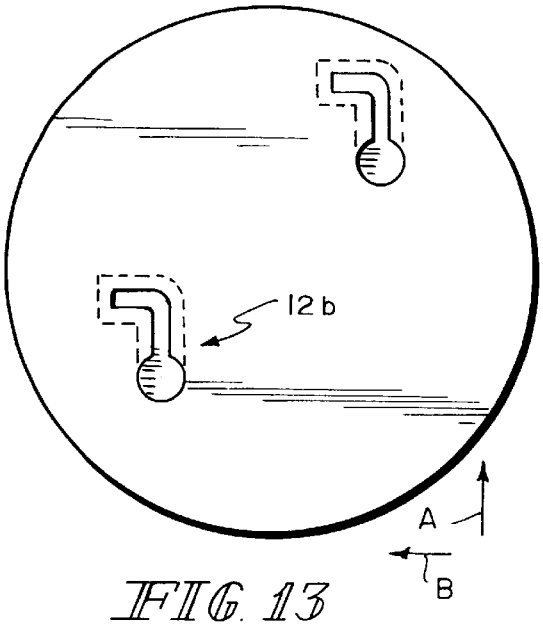
Figure 14:
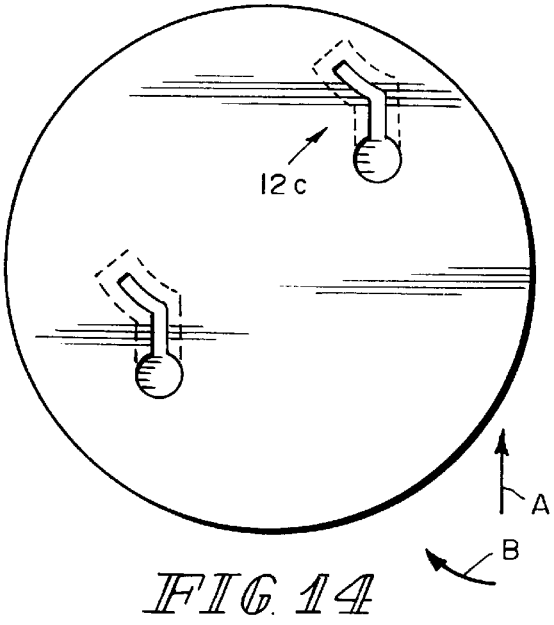

Instead of the link 32 having flat surfaces on its ends 34, the inner facing surfaces 38 of the ends 34 of the links 32*a* could be spherical in shape (FIGS. 10 and 11). The recesses 20*a* (FIG. 9) in the base element 10 have a corresponding spherical surface 40 with an angled conical throat 42. This spherical structure allows the link 32 to rotate in the recess 20*a* top to bottom and front to back to permit relative angular movement between adjoining base elements 10*a* and 10*b*.

Figure 15:
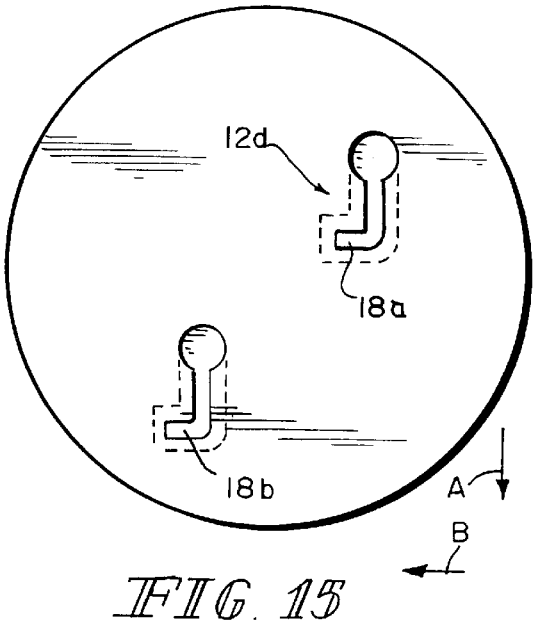

Various configurations of the partially covered tracks 12*a, b, d, d* are shown in FIGS. 12–15. The first coupling movement is shown by the respective arrows A and the second movement by the arrow B. In FIG. 15, as the upper pin 26 moves horizontally along second closed segment 18*a*, the outer visible element is rotated so that lower pin 26 traverses curved second segment 18*b*.

Figure 16:
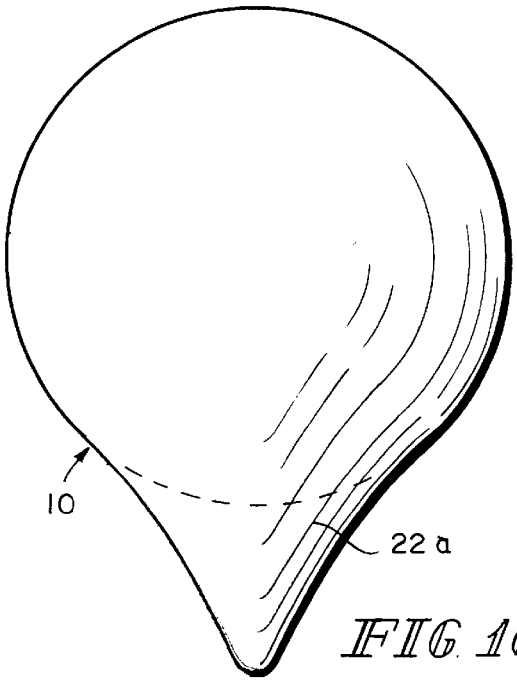
FIG. 16 shows a tear shaped visible element connected to a circular base element.
Figure 17:
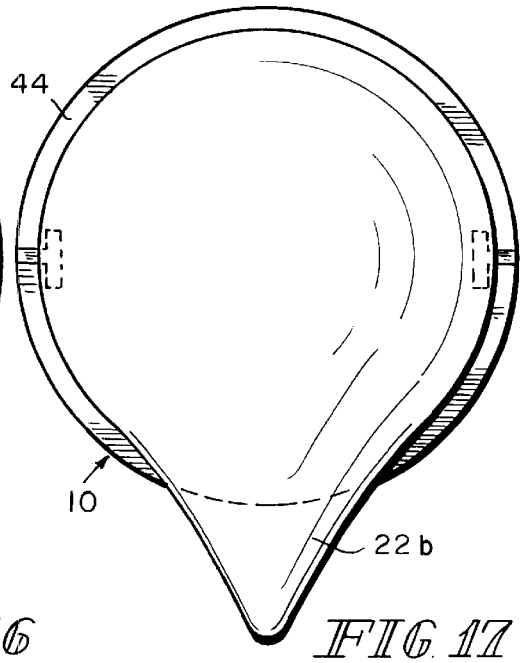
FIG. 17 shows a tear shaped visible element of smaller dimension connected to a circular base element wherein the recesses for connecting links is located on the underside of the visible element.

FIG. 16 shows a tear drop shaped outer visual element attached to a circular base element 10. FIG. 17 shows an outer visual tear drop shaped element 22*b* attached to a circular base element 10 wherein the tear drop shaped element 22*b* has a smaller bulbular end so that a portion of the base element is visible.

Figure 18:
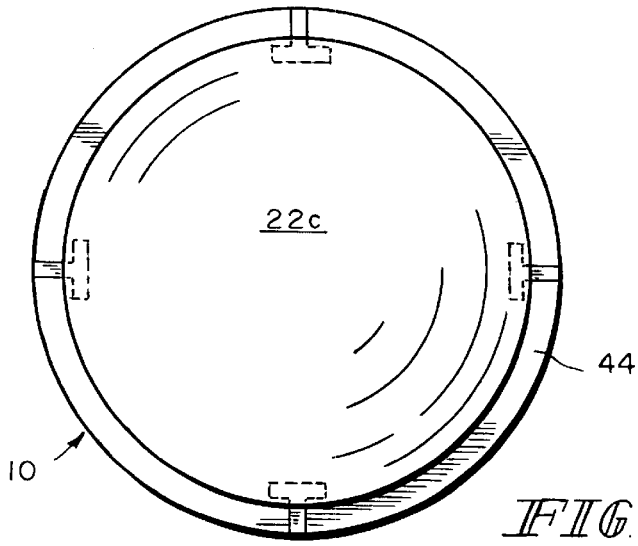
FIG. 18 shows a circular shaped visible element of smaller diameter than its base element wherein the connecting link recess is located on the base element.

If the base element 10 and tear drop element 22*b* are differently colored or made from differently colored materials, a border uncovered portion 44 of the base unit will exhibit a contrasting color scheme with the outer visible element 22*b*. FIG. 18 shows attaching different sized circular base element 10 with an outer visible element 22.

Figure 19:
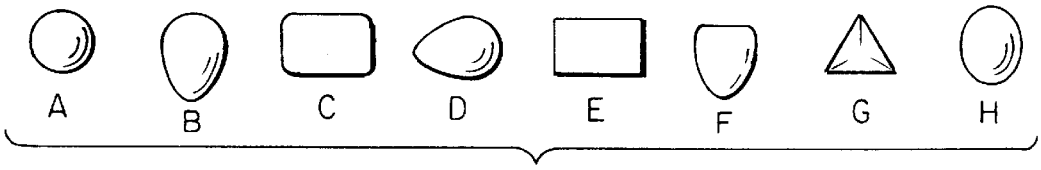
FIG. 19 shows a plurality of different shaped visible elements including a circle, tear-drop, rectangle with rounded corners, horizontal oval, rectangle, teardrop with flat top, triangle and vertical oval.
Figure 20:
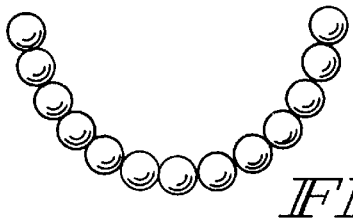
FIG. 20 shows a plurality of combined base and visible elements connected together to form a segment of a necklace, bracelet, or anklet.
Figure 21:
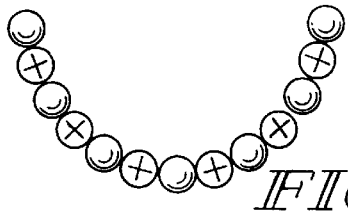
FIG. 21 shows the segment of FIG. 20 wherein alternative visible elements are differently colored.
Figure 22:
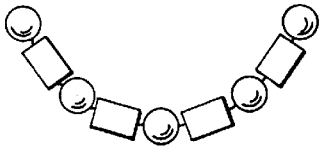
FIG. 22 shows a segment of a necklace, bracelet or anklet wherein alternative visible elements are circular separated by rectangular elements.
Figure 23:
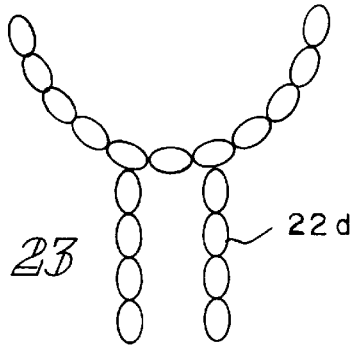
FIG. 23 shows a segment of necklace, bracelet, or anklet wherein two vertical lines of beads dangle downward from the segment.
Figure 24:
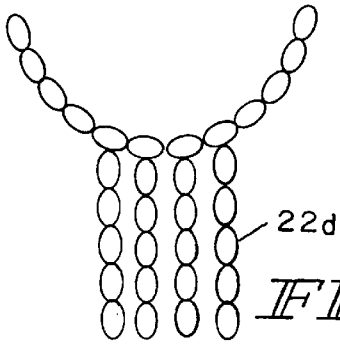
FIG. 24 shows a segment of a necklace, bracelet or anklet wherein four vertical lines of beads dangle downward from the segment.

FIG. 19 shows various configurations for the outer visible elements, namely a- circular
b- vertical tear-drop
c- rectangular with rounded comers
d- horizontal tear-drop
e- rectangular
f- vertical tear-drop with flat top
g- triangular
h- vertical oval, but the invention is not limited to these shapes. FIG. 20 shows a segment of a necklace, bracelet or anklet made from a plurality of round visible elements. FIG. 21 shows a similar configuration to FIG. 20 with alternative visual elements colored differently or made from differently colored materials. FIG. 21 shows combining circular and square visual elements to create a strand. FIG. 23 and FIG. 24 shows a strand of elements with dangling straight strings of visual elements 22 dangling from a strand. As can be seen in FIG. 1, there are four recesses in each base element to allow for attaching the straight strings 22*d* of FIGS. 23 and 24.

Figure 25:
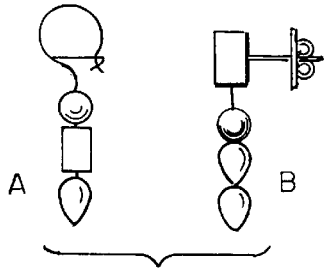
FIG. 25 A and B show a dangling earring utilizing the beads of the invention.
Figure 26:
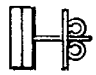
FIG. 26 shows a side view of a tuxedo stud utilizing the bead of the invention.
Figure 27:
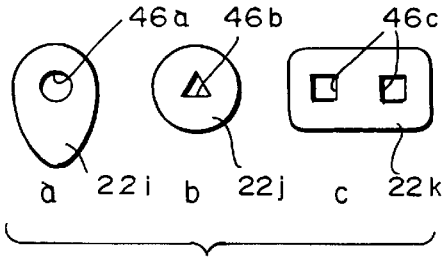
FIG. 27 shows outer visible elements with circular, triangle and rectangular shaped holes, to show the base element underneath.
Figure 28:
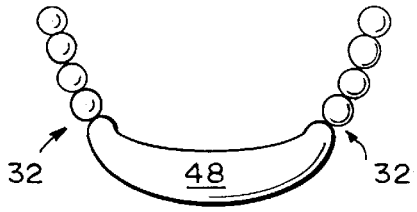
FIG. 28 shows a segment of a necklace, bracelet or anklet with a large elongated banana shaped bead.
Figure 34:
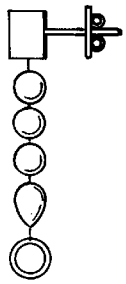
FIG. 34 shows a modified version of the earring of FIG. 25 utilizing the connector of FIG. 33.
Figure 33:
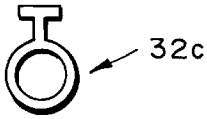
FIG. 33 shows a modified version of the connector of FIG. 6.
Figure 33:
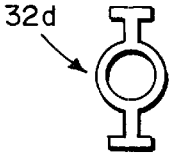
Figure 35:
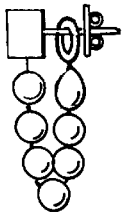
FIG. 35 shows an orientation for the earring of FIG. 34.

FIG. 25*a* shows a "euro-wire" earring and FIG. 25*b* shows a "post" style type earring made using the invention. The earring units can each be of the two piece construction of the invention or only some of the units be of the two piece construction. An opening loop can be inserted in the earring chain (see FIG. 34) by using a modified connector shown in FIGS. 33(A) and (B) to allow a earring to curve under an earlobe of a user to hook on to the "euro-wire" or "post" as shown in FIG. 35. FIG. 26 shows making a tie pin or tuxedo stud utilizing the invention. FIGS. 27*a, b* and *c* show forming the outer visible elements 22*i*, 22*j* and 22*k* with an opening 46*a*, 46*b*, 46*c* wherein the base element 10 can be seen through the opening in the outer visible elements. If the base element 10 is differently colored from these visual elements 22*i*, 22*j* and 22*k*, a special visual image is obtained.

Figure 29:
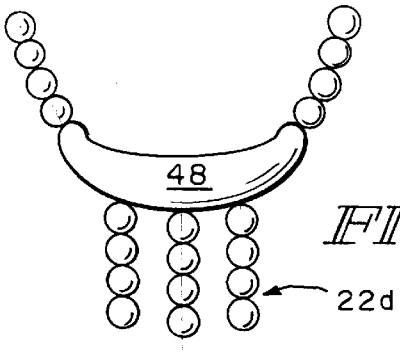
FIG. 29 shows the segment of FIG. 28 with vertical bead strings.
Figure 30:
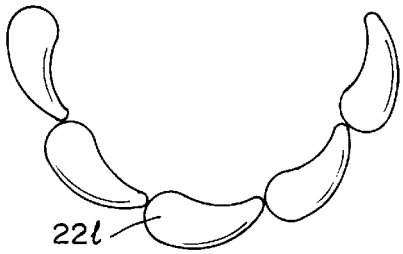
FIG. 30 shows a segment of a necklace, bracelet or anklet with curved teardrop shaped beaded elements.

FIG. 29 shows utilizing a large unitary element 48 attached by links 32 to units of the invention to create a jewelry strand. FIG. 29 is similar but with dangling chains 22 attached to the large unitary element 48. FIG. 30 shows a jewelry string made from curved tear dropped outer visible elements 22*d*.

Figure 31:
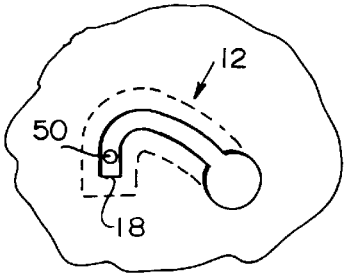
FIGS. 31 and 32 show exemplary tracks of the base unit where a protuberance is located on the bottom of the track (FIG. 31) or the side of the track (FIG. 32) for restraining uncoupling of the pin from the track.
Figure 32:
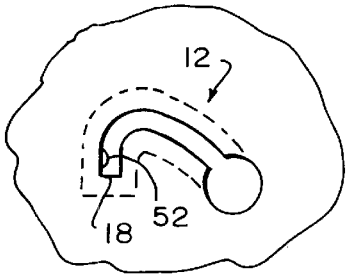

FIG. 31 and 32 show the placement of a protuberance 50 on the bottom of the second covered track segment 18 (FIG. 31) or the side of the second covered track segment to cause the assembler to squeeze the headed pins there past during assembling. The protuberances will inhibit uncoupling the base and outer visual elements.

In making a strand of jewelry not all of the elements need be made from the two part base and outer visual element, but could be a regular bead connected to another head in a conventional manner. The clasp for this type of jewelry strand would be made from the base and outer visual element of the invention.

Further, any combination of colors and/or shapes can be joined together to create a strand of ewelry. Further, the outer visible element could have a design emblem, or picture on its outer surface. For example, a collegiate piece of jewelry could have a clasp or unit with the school symbol or fraternity letter.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An ornamental jewelry kit comprising:

at least one inner flat base element having a flat upper surface;

a plurality of outer visible elements having a flat lower surface;

wherein the plurality of outer visible elements are comprised of visible elements differing from other visible elements by at least one of color material and shape;

cooperating connection means comprising parts on the flat surface of the base element and parts on the flat surface of visible elements for connecting the base and visible elements together along their respective flat surface;

the cooperating means including at least two partially covered tracks of and at least two posts with enlarged heads with the posts insertable into the tracks;

the partially covered tracks have an uncovered portion allowing an enlarged head of the posts to enter into the covered tracks;

the partially covered track is formed with at least a first passageway portion and a second passageway portion angled to the first passageway; and wherein a selected outer visible element is connected to the base element by aligning the at least two posts with respective uncovered portions of the covered tracks with the outer visible element offset from the respective base element, inserting the posts into the tracks, moving the outer visible element relative to the respective base element to cause the posts to move along the first passageway portion and then along the second angled passageway to a position where the outer visible element covers the base element.

2. The ornamental jewelry kit of claim 1 wherein the base element is formed with the at least two tracks.

3. The ornamental jewelry kit of claim 1 wherein the outer visible element is formed with the at least two tracks.

4. The ornamental jewelry kit of claim 1 wherein the base element is formed with one of the at least two tracks and the outer visible element is formed with the other of the at least two visible tracks.

5. The ornamental jewelry kit of claim 1 wherein the first passageway portions are curved.

6. The ornamental jewelry kit of claim 1 wherein the first passageway portions are straight.

7. The ornamental jewelry kit of claim 1 wherein the at least two tracks are oriented such that one track of the at least two tracks is oriented in a mirror image of the second of the at least two tracks.

8. The ornamental jewelry kit of claim 1 wherein the second passageways of the at least two tracks are oriented parallel to each other.

9. The ornamental jewelry kit of claim 1 wherein there are a plurality of inner flat base elements, and connector elements connecting at least some of the flat base elements together.

10. The ornamental jewelry kit of claim 9 wherein at least one connector element is releasable connected to another base element of the plurality of base elements.

11. The ornamental jewelry kit of claim 9 wherein at least two of the plurality of the outer visible elements are connected to one another.

12. The ornamental jewelry kit of 9 wherein the connection between two elements is provided by a link that is releasably connected to each of the two elements.

13. The ornamental jewelry kit of 10 wherein the connection between two elements is provided by a link that is releasably connected to each of the two elements.

14. The ornamental jewelry kit of 11 wherein the connection between two elements is provided by a link that is releasably connected to each of the two elements.

15. The ornamental jewelry kit of claim 12 wherein the connecting link has at least one enlarged end that rests in a recess formed in one of the elements.

16. The ornamental jewelry kit of claim 13 wherein the connecting link has at least one enlarged end that rests in a recess formed in one of the elements.

17. The ornamental jewelry kit of claim 14 wherein the connecting link has at least one enlarged end that rests in a recess formed in one of the elements.

18. The ornamental jewelry kit of claim 15 wherein the enlarged end of the connecting link has a curved surface pivotally mounted in the recess.

19. The ornamental jewelry kit of claim 16 wherein the connecting link has at least one enlarged end that rests in a recess formed in one of the elements.

20. The ornamental jewelry kit of claim 17 wherein the connecting link has at least one enlarged end that rests in a recess formed in one of the elements.

21. The ornamental jewelry kit of claim 14 wherein at least one connecting link has one end connected to a flat base element and another end connected to an outer visible element.

22. The ornamental jewelry kit of claim 15 wherein at least one connecting link has one end connected to a flat base element and another end connected to an outer visible element.

23. The ornamental jewelry kit of claim 16 wherein at least one connecting link has one end connected to a flat base element and another end connected to an outer visible element.

* * * * *